US009062634B1

(12) United States Patent
Wu et al.

(10) Patent No.: US 9,062,634 B1
(45) Date of Patent: Jun. 23, 2015

(54) EGR COOLER

(71) Applicant: Internaitonal Engine Intellectual Property Company, LLC, Lisle, IL (US)

(72) Inventors: Shouhao Wu, Roselle, IL (US); Robert Lawrence Rowells, Elmwood Park, IL (US)

(73) Assignee: Internaitonal Engine Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 14/247,868

(22) Filed: Apr. 8, 2014

(51) Int. Cl.
*F02M 25/07* (2006.01)

(52) U.S. Cl.
CPC ..... *F02M 25/0726* (2013.01)

(58) Field of Classification Search
CPC ..... F02M 25/0734; F02M 25/0737; F02M 25/0738; F02M 25/0731; F02M 25/0726; F02M 25/07; F28F 13/18; F28F 13/182; F28F 13/185; F28F 13/187; F28F 3/02; F28F 3/025; F28F 3/06; F28D 9/00; F28D 9/0006
USPC ..... 123/568.12
See application file for complete search history.

(56) References Cited

U.S. PATENT DOCUMENTS

| | | | | |
|---|---|---|---|---|
| 5,181,561 | A * | 1/1993 | Ayers et al. | 165/162 |
| 7,118,403 | B1 | 10/2006 | Williams | |
| 8,282,411 | B2 | 10/2012 | Jaquez | |
| 2006/0151158 | A1 * | 7/2006 | Ozaki | 165/173 |
| 2008/0011456 | A1 * | 1/2008 | Meshenky | 165/83 |
| 2008/0236792 | A1 * | 10/2008 | Mast et al. | 165/80.4 |

FOREIGN PATENT DOCUMENTS

| | | | | |
|---|---|---|---|---|
| GB | 2444792 | A * | 6/2008 | F02M 25/07 |

* cited by examiner

*Primary Examiner* — Hung Q Nguyen

(74) *Attorney, Agent, or Firm* — Jeffrey P. Calfa; Mark C. Bach

(57) ABSTRACT

An EGR cooler core has multiple tubes for conveying engine exhaust gas. Tube inlets are joined to a flat inlet header plate at tube/header plate joints in a flat zone of the inlet header plate. An endless groove in the inlet header plate circumscribes the joints while reducing a constant nominal thickness of the header plate in the flat zone along the groove without creating an opening through the header plate. This gives some compliance to the flat zone for mitigation of stresses induced by tube growth.

9 Claims, 5 Drawing Sheets

EGR COOLER

TECHNICAL FIELD

This disclosure relates generally to internal combustion engines, especially diesel engines in motor vehicles which use exhaust gas recirculation (EGR) as a component of tailpipe emission control strategy. The disclosure particularly relates to an EGR cooler for cooling exhaust gas being recirculated.

BACKGROUND

A typical EGR system of an engine includes one or more EGR valves for controlling the flow of engine exhaust gas from the engine's exhaust system to the engine's intake system to meter a controlled quantity of exhaust gas into fresh air passing through the intake system where the air supports combustion of fuel in the engine's cylinders. The metered exhaust gas can limit in-cylinder temperature rise during combustion and consequently limit the quantity of oxides of nitrogen (NOx) in engine-out exhaust gas.

Some EGR systems, especially those designed for compression ignition (i.e. diesel) engines, have one or more heat exchangers for cooling recirculated exhaust gas. They are sometimes referred to as EGR coolers. Cooling of exhaust gas being recirculated can further limit the quantity of NOx in engine-out exhaust gas.

SUMMARY OF THE DISCLOSURE

An EGR cooler currently used in a production engine has a housing which comprises a wall which extends lengthwise of the housing and has a transverse cross section enclosing an interior which extends lengthwise through the housing from a first open end of the housing to a second open end of the housing. The housing also has a coolant inlet through which engine coolant enters the interior and a coolant outlet through which coolant exits the interior.

A core is housed within the housing and comprises multiple tubes which extend lengthwise through the housing interior and through which exhaust gas is conveyed through the coolant core. Heat of exhaust gas flowing through the tubes is transferred through the tube walls to coolant flowing through the housing. The tubes are separated from each other by intervening spaces so that coolant flowing through the housing interior passes along the entire exterior surface of each tube.

An inlet header plate is disposed over the first open of the housing and comprises through-openings within each of which an open inlet end of a respective tube fits. Along a lengthwise segment of each tube, the exterior tube surface has dimensional clearance to a surrounding wall surface of the respective through-opening. Material is disposed in dimensional clearance space to extend continuously around the lengthwise segment of each tube and join the lengthwise segment with the surrounding wall surface of the respective through-opening, creating a fluid-tight seal between the exterior tube surface and the through-opening.

Open outlet ends of the tubes are received in and sealed to through-openings of an outlet header plate in a similar manner at the second lengthwise end of the housing.

Each header plate has a continuous perimeter margin disposed against the wall of the housing at a respective opposite end of the housing and a central region which is bounded by the continuous perimeter margin and overlies the respective housing end.

Like other engine components, an EGR cooler is subject to stresses which are thermally and mechanically induced. Mechanical constraints on certain cooler parts may lead to cooler failure because of the cumulative effect of such stresses as engine operating time accumulates.

For example, over time the material which joins a tube to a header plate (typically brazing material) may crack due to the cumulative effect of thermal cycles which occur as an engine warms up and cools down, thereby breaking the integrity of the joint. Stress increases due to tube growth as the engine warms up and continues running at operating temperature. Stress decreases as tube growth reverses once the engine is shut off and begins to cool down.

If the lengths of the tubes between the header plates are long enough to subject them to unwanted vibration, mid-core spring clips may be employed in mitigation of the effects of mechanically induced vibration. However in doing so, the spring clips may amplify the effect of thermally induced stress on the core, especially between the spring clips and the inlet header plate. Relaxing the spring force of these clips for the purpose of attenuating the amplification is counterproductive to their effectiveness against vibration.

Stresses which tend to break the integrity of joints between the tubes and through-openings in a header plate, especially an inlet header plate, are mitigated by creating at least one endless groove in a flat zone of a central region of a header plate which contains the through-openings and which has a constant nominal thickness between opposite faces. The endless groove circumscribes the through-openings and reduces the constant nominal thickness of the flat zone along the groove without creating an opening through the flat zone between its opposite faces.

The endless groove imparts a degree of compliance to the flat zone which allows it to deform slightly and thereby mitigate stresses at the tube/header plate joints as the tubes grow. The endless groove can be created by known machining processes, such as milling for example. Various groove profiles are contemplated.

One profile is created by machining grooves into opposite faces of a header plate to establish an "S" shaped profile. As the tubes are heated by hot exhaust gas and/or engine coolant, they grow axially. With the endless groove having an "S" shaped profile, the header plate zone circumscribed by the endless groove is able to slightly deform as the tubes grow. The deformation occurs with resiliency which allows the zone to undeform as tube growth reverses with cooling.

The nominal thickness of the header plate is established by selecting a minimum surface area at each tube/header plate joint for proper brazing. Without the endless groove, the selected thickness does not allow the central region to have compliance for accommodating tube growth and consequently after a sufficient number of repeated thermal cycles, a tube, or its joint at the header plate, may eventually fail such as by the tube separating from the header plate, or breaking at or near the braze joint.

A general aspect of this disclosure relates to an EGR cooler comprising a core and a housing which houses the core. The housing comprises a wall which extends lengthwise of the housing and has a transverse cross section enclosing an interior which extends lengthwise through the housing from a first open end to a second open end.

The core comprises multiple straight tubes which extend lengthwise through the interior and are spaced apart from each other, and a header plate having a continuous perimeter margin disposed against the wall of the housing at the first open end and a central region which is bounded by the continuous perimeter margin and overlies the first open end.

The central region comprises multiple through-openings each receiving an open end of a respective tube, each through-opening presenting a wall surface surrounding, and having dimensional clearance to, an outside surface of a respective tube along a lengthwise segment of the respective tube.

Joining material which extends continuously around the lengthwise segment of each tube joins the lengthwise segment of each tube with the surrounding wall surface of the respective through-opening and creates a fluid-tight seal between the tube and the through-opening.

The central region comprises a flat zone, of constant nominal thickness as measured lengthwise of the housing between opposite faces of the central region, the flat zone containing at least one endless groove which circumscribes the through-openings while reducing the constant nominal thickness of the flat zone along the groove without creating an opening through the flat zone between opposite faces of the central region.

The foregoing summary is accompanied by further detail of the disclosure as presented in the Detailed Description below with reference to the following drawings which are part of the disclosure.

DETAILED DESCRIPTION

Figure 1:
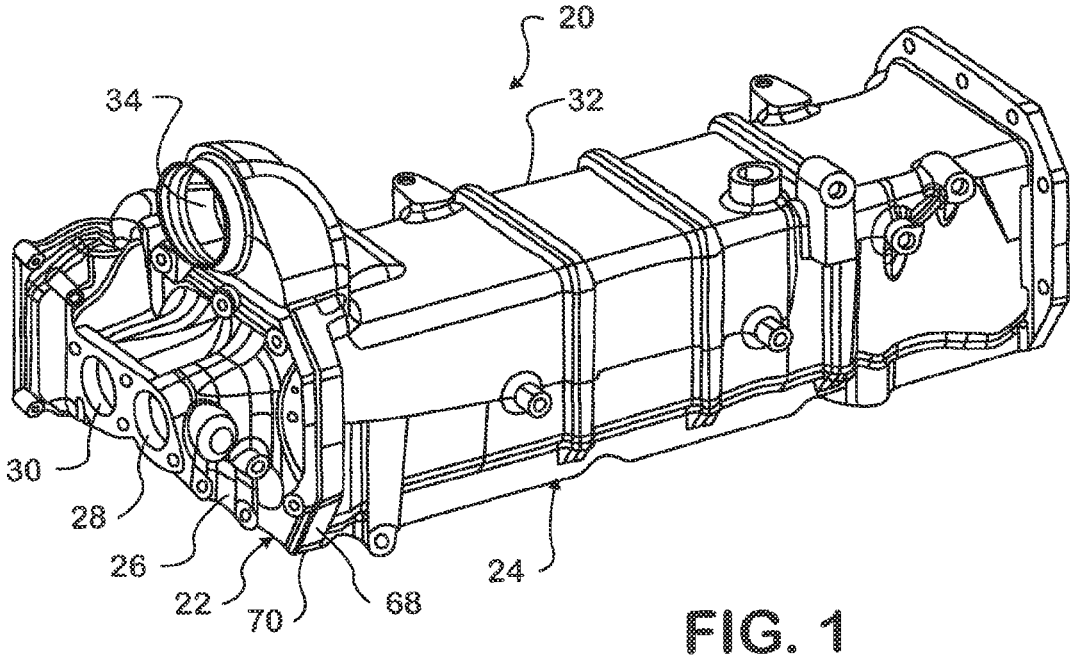
FIG. 1 is a perspective view of an EGR valve and cooler assembly.
Figure 2:
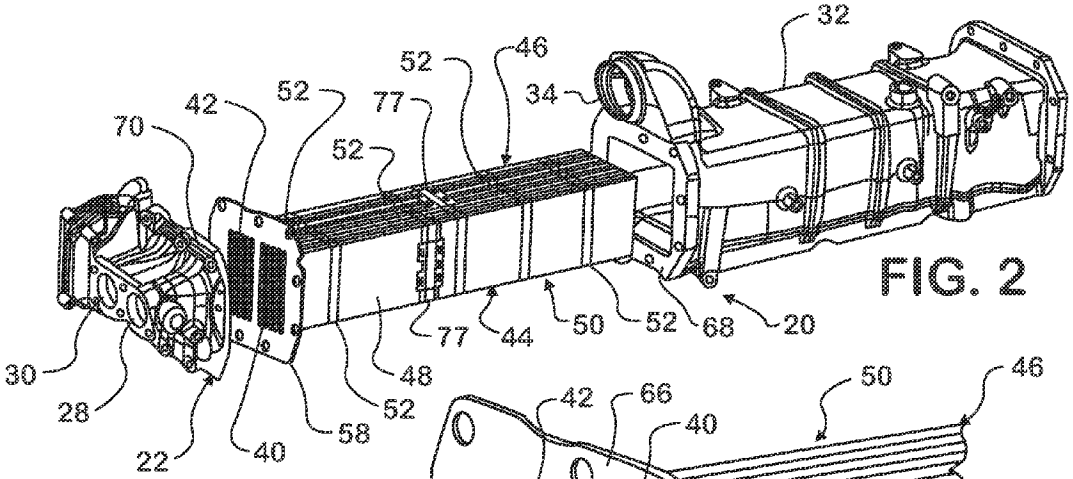
FIG. 2 is an exploded perspective view of FIG. 1 showing a core of the cooler.
Figure 3:
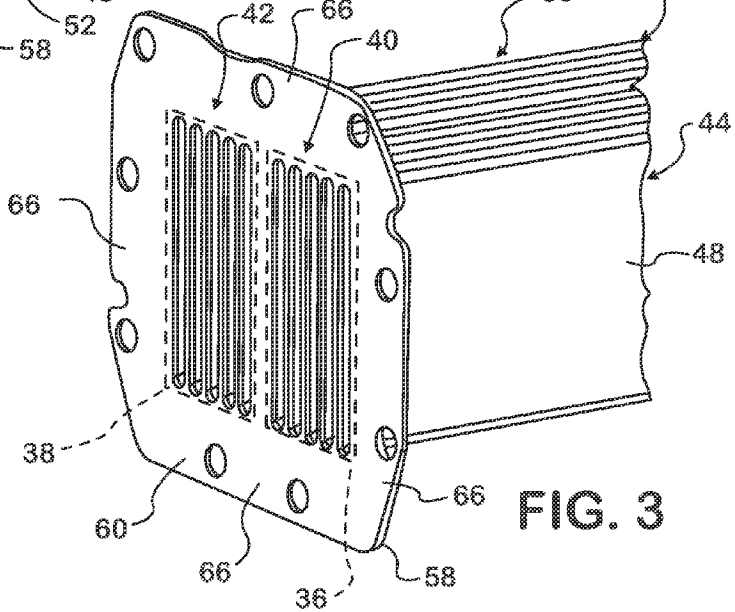
FIG. 3 is an enlarged fragmentary perspective view of an inlet end of the core which includes an inlet header plate.

FIGS. 1 and 2 show an EGR valve and cooler assembly 20 comprising an EGR valve 22 and an EGR cooler 24. EGR valve 22 comprises a valve housing 26 having a pair of inlets 28, 30 through which engine exhaust gas being recirculated enters assembly 20. EGR cooler 24 comprises a cooler housing 32 having a coolant inlet 34 through which engine coolant enters. Valve housing 26 has a pair of outlets 36, 38 indicated by broken lines in FIG. 3. Each outlet 36, 38 is open to an inlet 40, 42 of a respective set of tubes 44, 46, each set comprising a number of straight, flat-walled tubes 48 arranged side-by-side. Each tube set has a respective outlet (unnumbered) at the far end as seen in FIG. 2. The tubes sets are elements of a lengthwise extending core 50 of EGR cooler 24.

The tubes 48 of each tube set 44, 46 are banded together by bands 52 to convert each tube set into a banded tube bundle. Each tube set 44, 46 has a generally rectangular-shape comprising a top, a bottom, and two sides.

Tubes 48 are identical flat-walled tubes arranged side-by-side with their flat walls separated from flat walls of adjacent tubes by intervening spaces. The flat parallel sides of each tube are joined by rounded ends at top and bottom. At inlets 40, 42, an entrance end of each tube 48 in each tube set 44, 46 is disposed within a respective through-opening 56 in an inlet header plate 58 which has opposite faces 60, 62 (see FIG. 5 also) between which through-openings 56 extend. At outlet ends of the tube sets each tube 48 is associated with a respective through-opening in an outlet header plate (not shown).

Through-openings 56 take the shapes of through-slots which conform to the cross sections of tubes 48, but are slightly larger to provide dimension clearance which allows tubes 48 to be inserted into them and thereafter joined to the header plates by brazing. Along a lengthwise segment of each tube 48 disposed within a through-opening 56, the exterior tube surface has dimensional clearance to a surrounding wall surface of the through-opening Material (braze 64 seen in FIG. 5) is disposed in the dimensional clearance space to extend continuously around the lengthwise segment of each tube and join the lengthwise segment with the surrounding wall surface of the respective through-opening, creating a fluid-tight seal between the exterior tube surface and the through-opening. Because the through-openings in each header plate are separated from each other, this joining of tubes 48 to the header plates keeps the side-by-side tubes 48 separated from adjacent tubes 48 by intervening spaces between the tubes' flat side walls.

Inlet header plate 58 has a continuous perimeter margin 66 which is disposed against a flange 68 at the inlet end of cooler housing 32 and held between it and a flange 70 of valve housing 26 by fasteners (not shown) passing through aligned holes in perimeter margin 66 and flanges 68, 70, gaskets 80 providing sealing between perimeter margin 66 and the housing flanges. Each respective valve outlet 36, 38 is open to the entrances of the tubes 48 in the respective tube set 44, 46.

Perimeter margin 66 circumscribes a central region 72 of inlet header plate 58 which overlies the open inlet end of cooler housing 32 and contains through-openings 56. Inlet header plate 58 is fabricated from flat material which has a constant nominal thickness as measured lengthwise of cooler housing 32 between opposite faces 60, 62. A flat zone 74 within central region 72 contains at least one endless groove 76 which circumscribes through-openings 56 while reducing the constant nominal thickness between faces 60, 62 along the length of the groove without creating an opening through flat zone 74 between opposite faces 60, 62. The endless groove is shown in FIG. 4 only schematically, and various embodiments will be described later.

Figure 4:
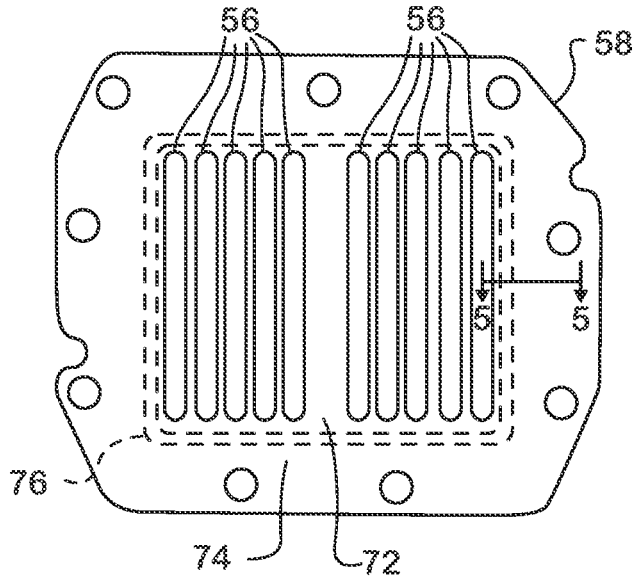
FIG. 4 is a plan view of the inlet header plate.

As viewed in FIG. 4, endless groove 76 comprises four sides, a first pair of the four sides being parallel with each other, and a second pair of the four sides being parallel with each other. The sides of the first pair are at right angles to the sides of the second pair. 90° curved segments join each side of the first pair with the sides of the second pair.

An end cap (not shown) fits over and is joined to the outlet header plate opposite tube sets 44, 46 for communicating the outlet ends of tubes 48 in each set to exhaust outlet openings in a cover covering the far end of coolant housing 32 in FIG.

2 but not shown. The cover also includes coolant outlet openings for engine coolant which has passed through the coolant housing interior along tubes 48 and around the outside of the end cap.

Along the lengths of tube sets 44, 46, the interior of coolant housing 32 has a uniform rectangular cross section bounded by interior surfaces of a top wall, a bottom wall, and side walls of cooler housing 32. Exhaust gas which has entered EGR cooler 24 from EGR valve 22 flows through tubes 48 to exit EGR cooler 24 through the end cap and the exhaust outlet openings in the cover. Engine coolant which has entered EGR cooler 24 from the engine coolant system through coolant inlet 34 flows concurrently through the interior of cooler housing 32 and leaves through the coolant outlet openings in the cover. Exhaust gas and liquid coolant flow through EGR cooler 24 in parallel directions without mixing but in heat transfer relation through the thermally conductive walls of tubes 48.

Collectively, tube sets 44, 46 have a rectangular cross section smaller than that of the interior of cooler housing 32. In addition to support for the tube sets provided by the attachment of their tubes 48 to the header plates, tube sets 44, 46 may be supported at locations along their length on the housing walls by spring clips 77 which bear against the interior surface of a respective wall and are intended to aid in attenuating vibration.

Figure 5:
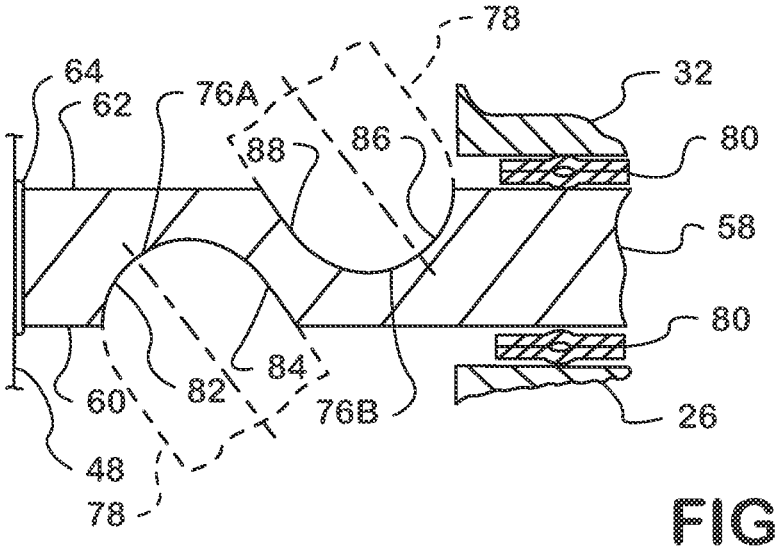
FIG. 5 is an enlarged fragmentary cross section view through the inlet header plate in the direction of arrows 5-5 in FIG. 4 with the coolant core in place in the EGR valve and cooler assembly.

FIG. 5 shows one example of an endless groove 76. A first endless groove portion 76A is disposed in face 60 and a second endless groove portion 76B is disposed in the opposite face 62. This particular groove profile is created by machining portions 76A, 76B in inlet header plate 58 and thereby establishing an "S" shaped profile. With this "S" shaped profile for endless groove 76, the portion of flat zone 74 circumscribed by the endless groove is able to slightly deform as tubes 48 grow. The deformation occurs with resiliency which allows the circumscribed portion of the zone to undeform as tube growth reverses with cooling.

Portions 76A, 76B are machined in inlet header plate 58 prior to assembly of tubes 48. FIG. 5 illustrates how a hemispherical tip milling cutter 78, cutting at an angle to the header plate, can cut groove portions 76A, 76B in opposite faces 60, 62 to give some degree of compliancy to the surrounded portion of flat zone 74. One groove portion is first machined and then the other.

The result of the milling gives each groove portion a respective concave transverse cross section which is at least partially spherical. The concave transverse cross section of groove portion 76A which is at least partially spherical has a partially spherical surface 82 which begins at face 60 and ends at a depth from face 60. The concave transverse cross section of groove portion 76A further comprises a flat surface 84 which extends from the end of its partially spherical surface 82 to face 60 to form an obtuse angle with face 60.

The concave transverse cross section of groove portion 76B which is at least partially spherical has a partially spherical surface 86 which begins at face 62 and ends at a depth from face 62. The concave transverse cross section of groove portion 76B further comprises a flat surface 88 which extends from the end of its partially spherical surface 86 to face 62 to form an obtuse angle with face 62.

Flat surface 84 is disposed more distant from tubes 48 than is partially spherical surface 82, and flat surface 88 is disposed less distant from tubes 48 than is partially spherical surface 86. The apex of the obtuse angle which flat surface 84 makes with face 60 is disposed more distant from tubes 48 than is the apex of the obtuse angle which flat surface 88 makes with face 62. That creates the "S" shaped profile. A mirror image of the "S" shaped profile results when the groove portions are reversed by machining groove portion 76A in face 62 and groove portion 76B in face 60. Functionally, the mirror image is the same as shown in FIG. 5.

FIGS. 6-9 illustrate on a somewhat exaggerated scale how an endless groove 76 can mitigate stresses created by tube growth.

Figure 6:
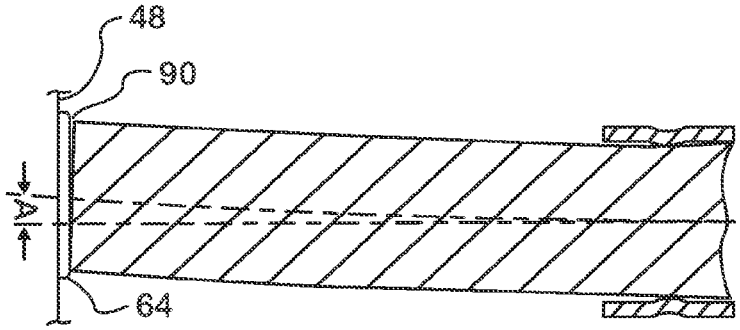
FIG. 6 is a fragmentary cross section view through a different inlet header plate.
Figure 7:
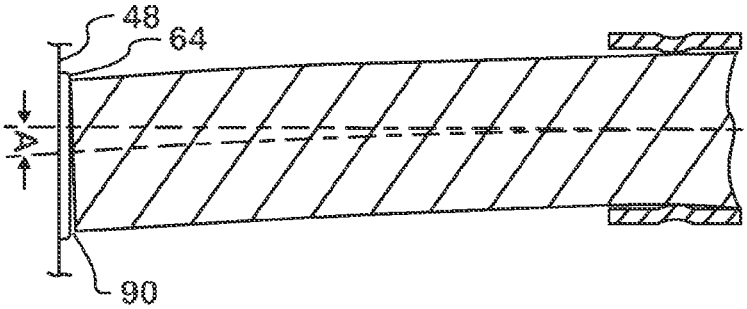
FIG. 7 is another fragmentary cross section view through the inlet header plate shown in FIG. 6.

FIGS. 6 and 7 show little or no compliance of a grooveless header plate which has constant thickness throughout between its opposite faces when subjected to tube growth which causes deflection D. The grooveless header plate is representative of a header plate which has been used in commercially manufactured EGR coolers having tubes which can flex in either direction as shown by these respective Figs. The cumulative effect of repeated stresses can cause braze and/or a tube to crack as indicated at 90 regardless of whether a tube is repeatedly flexed in only one direction or in opposite directions as it repeatedly grows and shrinks due to thermal cycling.

Figure 8:
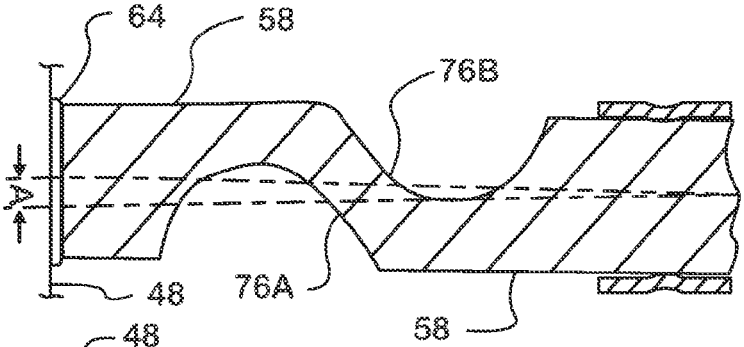
FIG. 8 is a fragmentary cross section view through the inlet header plate shown in FIGS. 3 and 4.
Figure 9:
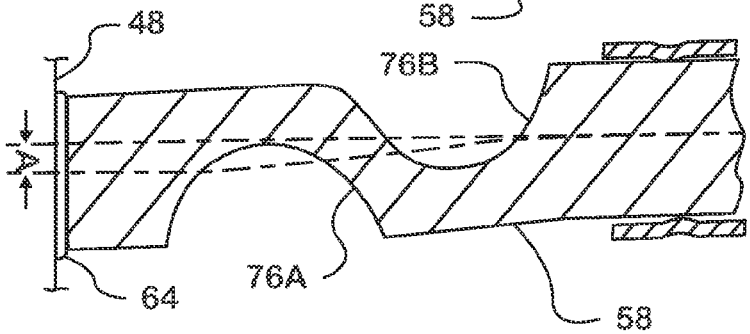
FIG. 9 is another fragmentary cross section view through the inlet header plate shown in FIGS. 3 and 4.
Figure 10:
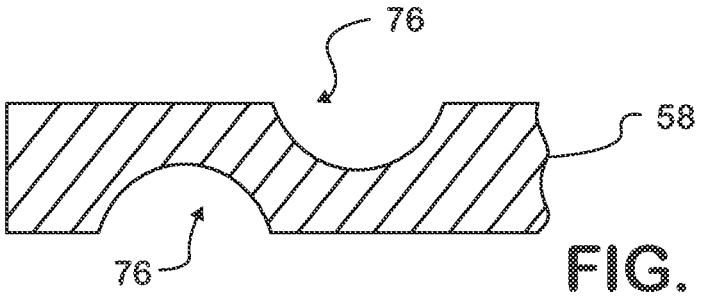
FIG. 10 is a fragmentary cross section view through another inlet header plate similar to the one shown in FIGS. 3 and 4.
Figure 11:
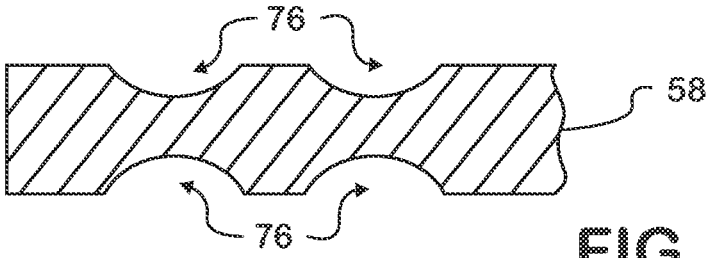
FIG. 11 is a fragmentary cross section view through still another inlet header plate.
Figure 12:
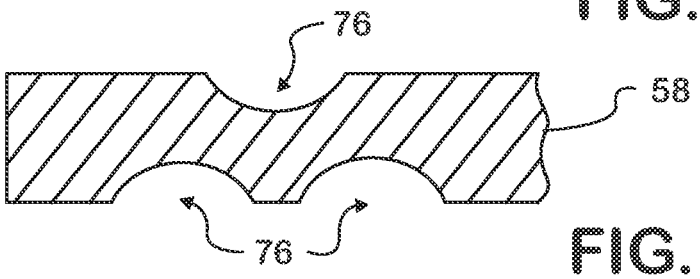
FIG. 12 is a fragmentary cross section view through still another inlet header plate.
Figure 13:
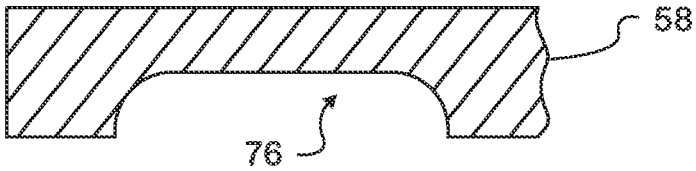
FIG. 13 is a fragmentary cross section view through still another inlet header plate.
Figure 14:
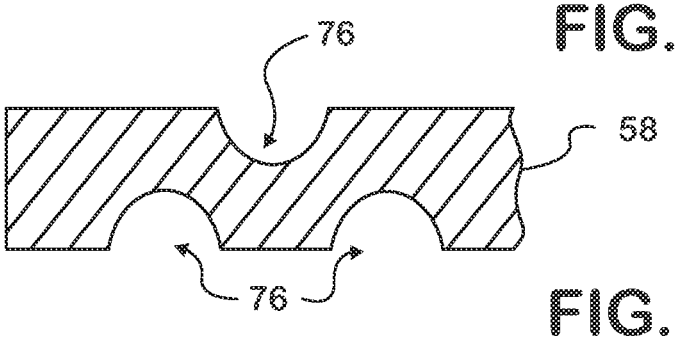
FIG. 14 is a fragmentary cross section view through still another inlet header plate.

When an endless groove 76 such as the one shown in FIG. 5 is present in a header plate, FIGS. 8 and 9 show a noticeable degree of compliance in both directions of tube flexing due to tube growth, mitigating stresses which would otherwise occur in a grooveless header plate.

Various other embodiments of endless grooves 76 are shown in FIGS. 10-14. They show variations in number of grooves, in depth of cut, and in groove width. While the use of an angled hemispherical milling cutter as described above is a suitable way to create one or more grooves which impart compliancy to a header plate, acceptable grooves may be machined in other ways using other milling cutter shapes, such as a conical milling cutter for example, and different cutter angles which may be as great as the cutter axis being at 90° to a face of a header plate.

What is claimed is:

1. An EGR cooler comprising:

a core;

a housing which houses the core;

the housing comprising a wall which extends lengthwise of the housing and has a transverse cross section enclosing an interior which extends lengthwise through the housing from a first open end to a second open end;

the core comprising multiple straight tubes which extend lengthwise through the interior and are spaced apart from each other;

a header plate having a continuous perimeter margin disposed against the wall of the housing at the first open end and a central region which is bounded by the continuous perimeter margin and overlies the first open end;

the central region comprising multiple through-openings each receiving an open end of a respective tube, each through-opening presenting a wall surface surrounding, and having dimensional clearance to, an outside surface of a respective tube along a lengthwise segment of the respective tube;

joining material which extends continuously around the lengthwise segment of each tube to join the lengthwise segment of each tube with the surrounding wall surface of the respective through-opening and create a fluid-tight seal between the tube and the through-opening;

the central region comprising a flat zone, of constant nominal thickness as measured lengthwise of the housing between opposite faces of the central region, the flat zone containing at least one endless groove which circumscribes the through-openings while reducing the constant nominal thickness of the flat zone along the groove without creating an opening through the flat zone between opposite faces of the central region.

2. The EGR cooler as set forth in claim 1 in which the endless groove comprises four sides as viewed lengthwise of the housing, a first pair of the four sides being parallel with each other, and a second pair of the four sides being parallel with each other, and the sides of the first pair being at right angles to the sides of the second pair.

3. The EGR cooler as set forth in claim 2 in which the endless groove comprises 90° curved segments joining each side of the first pair with the sides of the second pair.

4. The EGR cooler as set forth in claim 1 in which the endless groove comprises a first portion disposed in a first of the opposite faces of the central region and a second portion disposed in a second of the opposite faces.

5. The EGR cooler as set forth in claim 4 in which the first portion has a concave transverse cross section which is at least partially spherical and the second portion has a concave transverse cross section which is at least partially spherical.

6. The EGR cooler as set forth in claim 5 in which the concave transverse cross section of the first portion which is at least partially spherical has a partially spherical surface which begins at the first face and ends at a depth from the first face, the concave transverse cross section of the first portion further comprising a flat surface which extends from the end of its partially spherical surface to the first face to form an obtuse angle with the first face, and in which the concave transverse cross section of the second portion which is at least partially spherical has a partially spherical surface which begins at the second face and ends at a depth from the second face, the concave transverse cross section of the second portion further comprising a flat surface which extends from the end of its partially spherical surface to the second face to form an obtuse angle with the second face.

7. The EGR cooler as set forth in claim 6 in which the flat surface of the concave transverse cross section of the first portion is disposed more distant from the tubes than is the partially spherical surface of the concave transverse cross section of the first portion, and in which the flat surface of the concave transverse cross section of the second portion is disposed less distant from the tubes than is the partially spherical surface of the concave transverse cross section of the second portion.

8. The EGR cooler as set forth in claim 7 in which the apex of the obtuse angle which the flat surface of the concave transverse cross section of the first portion makes with the first face is disposed more distant from the tubes than is the apex of the obtuse angle which the flat surface of the concave transverse cross section of the second portion makes with the second face.

9. The EGR cooler as set forth in claim 1 in which the tubes comprises flat-walled tubes arranged side-by-side with their flat walls separated from flat walls of adjacent tubes by intervening spaces.

* * * * *